US008123904B2

(12) United States Patent
Akhtar et al.

(10) Patent No.: US 8,123,904 B2
(45) **Date of Patent: *Feb. 28, 2012**

(54) METHOD OF MAKING MEDIUM DENSITY FIBERBOARD

(75) Inventors: Masood Akhtar, Middleton, WI (US); William R. Kenealy, Madison, WI (US); Eric G. Horn, Madison, WI (US); Ross E. Swaney, Madison, WI (US); Jerrold Winandy, Mazomanie, WI (US)

(73) Assignees: Wisconsin Alumni Research Foundation, Madison, WI (US); Biopulping International Inc., Madison, WI (US); The United States of America as represented by the Secretary of Agriculture, Washington, DC (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/854,574

(22) Filed: Aug. 11, 2010

(65) Prior Publication Data

US 2010/0300634 A1 Dec. 2, 2010

Related U.S. Application Data

(62) Division of application No. 11/849,070, filed on Aug. 31, 2007, now abandoned.

(60) Provisional application No. 60/824,383, filed on Sep. 1, 2006.

(51) Int. Cl.

| | |
|---|---|
| ***D21C 3/20*** | (2006.01) |
| ***D21C 1/00*** | (2006.01) |
| ***D21B 1/04*** | (2006.01) |
| ***D21J 1/00*** | (2006.01) |

(52) U.S. Cl. ..... 162/72; 162/76; 162/77; 162/164.1; 428/34.2

(58) Field of Classification Search ..... 162/63, 162/72, 75, 76, 77

See application file for complete search history.

(56) References Cited

U.S. PATENT DOCUMENTS

| | | | | |
|---|---|---|---|---|
| 5,756,599 | A | 5/1998 | Teodorczyk | |
| 5,853,534 | A | 12/1998 | Hoglund et al. | |
| 6,248,812 | B1 | 6/2001 | Symons | |
| 6,267,841 | B1 * | 7/2001 | Burton | 162/24 |
| 6,399,719 | B1 | 6/2002 | Dopico et al. | |
| 6,916,507 | B2 | 7/2005 | Matsumura et al. | |
| 7,008,505 | B2 | 3/2006 | Akhtar et al. | |
| 7,306,698 | B2 | 12/2007 | Akhtar et al. | |
| 2001/0030016 | A1 * | 10/2001 | Lynch et al. | 156/196 |
| 2003/0041985 | A1 * | 3/2003 | Akhtar et al. | 162/83 |
| 2009/0194243 | A1 * | 8/2009 | Akhtar et al. | 162/63 |

FOREIGN PATENT DOCUMENTS

| | | | |
|---|---|---|---|
| EP | 0584675 | A1 | 3/1994 |
| EP | 1716995 | A2 | 11/2006 |
| WO | 2007008689 | A2 | 1/2007 |

OTHER PUBLICATIONS

PCT International Search Report, PCT/US2007/077504, Feb. 6, 2008.

PCT International Preliminary Report on Patentability, PCT/US2007/077504, Mar. 3, 2009.

United States Patent and Trademark Office, Office Action Summary and Detailed Action, U.S. Appl. No. 11/849,070, Jul. 29, 2009.

Applicant, Response to Restriction Requirement and Amendment, U.S. Appl. No. 11/849,070, Sep. 29, 2009.

United States Patent and Trademark Office, Office Action Summary and Detailed Action, U.S. Appl. No. 11/849,070, Oct. 30, 2009.

Applicant, Response to Office Action, U.S. Appl. No. 11/849,070, Feb. 1, 2010.

United States Patent and Trademark Office, Office Action Summary and Detailed Action, U.S. Appl. No. 11/849,070, May 12, 2010.

Applicant, Response to Final Office Action, U.S. Appl. No. 11/849,070, Aug. 11, 2010.

United States Patent and Trademark Office, Advisory Action Before the Filing of an Appeal Brief, U.S. Appl. No. 11/849,070, Aug. 24, 2010.

* cited by examiner

*Primary Examiner* — Matthew Daniels
*Assistant Examiner* — Anthony Calandra
(74) *Attorney, Agent, or Firm* — Quarles & Brady LLP; Sara D. Vinarov

(57) ABSTRACT

The present invention provides a method for producing an MDF board from pulp from a fibrous lignocellulose material using a treatment or pretreatment step which exposes the material to oxalic acid or oxalic acid derivatives (particularly dialkyl ester derivatives, particularly in the vapor phase). The treated wood is then subjected to a sugar extraction wash and refined using any one of the several pulping methods to produce a final pulp product. Once this is done the pulp is used to make MDF boards having improved water repellency properties.

21 Claims, No Drawings

METHOD OF MAKING MEDIUM DENSITY FIBERBOARD

CROSS-REFERENCE TO RELATED APPLICATIONS

"This application is a divisional application of U.S. application Ser. No. 11/849,070, filed on Aug. 31, 2007 now abandoned, which claims priority to U.S. Provisional application Ser. No. 60/824,383, filed on Sep. 1, 2006. Each of these applications is incorporated by reference in its entirety ".

STATEMENT REGARDING FEDERALLY SPONSORED RESEARCH OR DEVELOPMENT

This invention was made with United States government support awarded by the following agency: DOE Grant# R530539 and DOA# DE-FG45-02R530539. The United States has certain rights in this invention.

BACKGROUND OF THE INVENTION

Lignocellulosic materials are sources for the generation of a variety of products. Some of the products retain significant structural components of the lignocellulose such as mechanical pulp fibers from wood chips. Other compounds such as sugars derived from the carbohydrate in lignocellulose are made into products by fermentation or chemical conversion. The lignocellulose can be made into products that represent a continuum of structured to molecular products. The continuum of products is generated by a variety of physical, chemical, biological and thermal processes.

Medium-density fiberboard (MDF) is an engineered wood product formed by lignocellulosic fibers glued under heat, pressure and a small amount of resin. In manufacturing MDF from wood, the wood is first reduced to an intermediate stage in which the fibers in the wood are separated from their natural environment and transformed into a pulp like suspension. One of the components of wood is lignocellulose. The most abundant component of lignocellulose is the cellulose polymers. These are the most desired polymers in the final product. The second most abundant polymer is lignin. Lignin is useful as a material which allows fibers to adhere in MDF.

The third major component of lignocellulose is the hemicellulose. Hemicelluloses are polymers of sugars that are more heterogeneous than cellulose. The hemicelluloses are comprised of oligomeric sugars derived from arabinose, galactose, xylose and mannose in addition to glucose. The hemicellulose and the lignin are intermixed with the cellulose in lignocellulose and serve to protect the cellulose from damage by organisms, enzymes or chemicals. Removal of the hemicellulose and lignin is often a portion of lignocellulose processing.

Pulp suitable for MDF production may be produced from various types of lignocellulose using any one of several techniques. The simplest of these techniques is the refiner mechanical pulping (RMP) method in which a mechanical milling operation grinds or abrades wood in water until a desired state of freeness (an arbitrary measure of water drainage) is achieved between its fibers. The RMP method is high yield, typically converting approximately 95% of the dry weight of the wood into pulp. The RMP method leaves most of the lignin and hemicellulose in the pulp.

Other mechanical pulping methodologies include thermo-mechanical pulping (TMP), chemical treatment with thermo-mechanical pulping (CTMP), and chemi-mechanical pulping (CMP). Alternatively there are also chemical pulping methods, wherein a chemical/water solution is generally used to dissolve the lignin and hemicellulose to promote the separation of the fibers.

In thermo-mechanical processes (e.g. TMP and CTMP), high temperatures are used to help separate the fibers during refining. These processes generally require the refining to be carried out in one or more steps. The first step is usually a pressurized step with refining being performed at temperatures above 100° C. and immediately below or at the softening temperature of lignin. During this step, the pulp is typically mechanically processed using the TMP method. In subsequent steps, the pressure and temperature is usually modulated to achieve the desired state of freeness between the fibers.

Relatively high total electric energy amounts or high quantities of input lignocellulose are required to produce pulps using the above mentioned mechanical pulping techniques. In particular, high energy inputs are generally required to obtain fiber separation in woods rich in lignin as such woods typically call for extended refining periods and higher refining temperatures or pressures. Recent studies have also suggested that even thermal or chemical softening treatments of such woods do not guarantee a lower total energy consumption. This is because unprocessed fibers which are only mildly separated by the thermal or chemical treatments are difficult to fibrillate during the mechanical refining process.

Fibrillation is necessary to increase the flexibility of the fibers and bring about the fine material characteristics of quality processed pulp. In fact, it has been suggested that a decrease in the energy consumption from an established level in various TMP and CTMP processes has been associated with the deterioration of certain pulp properties, including a reduction in the long fiber content of the pulp (See U.S. Pat. No. 5,853,534, which is incorporated by reference here in its entirety). As a result, high energy consumption in TMP and CTMP processes has been generally necessary in today's pulping practices.

Along with the problems of the high energy cost of pulping, MDF has the problem of generally having low moisture tolerance. MDF, therefore, often swells when contacted with water and is therefore of more limited use in outdoor settings and in applications that encounter moisture such as furniture surfaces. Absorption of moisture also often causes significant deterioration in the mechanical integrity of the MDF.

In regards to reducing the energy costs of pulping, applicants invented a method for producing pulp from fibrous lignocellulose material using a treatment step which exposes the material to oxalic acid, or oxalic acid and sodium bisulfite, prior to pulping. Applicants discovered that pulping the resulting product actually required less energy input and provided a pulp with enhanced physical properties as compared to untreated fibrous lignocellulose material (see, U.S. Patent Publication No. 20030041985). From this applicants determined that pretreatment with oxalic acid or oxalic acid derivatives reduced energy requirements in mechanical refining for making paper. This technology is different from that which is described hereinbelow for MDF, as the properties of fibers relevant to making paper sheets are specific to paper products and are not related to the properties that fibers will exhibit when formed into MDF. In particular, the methods described below produce MDF that has, in-part, improved water repellency, a resulting characteristic that is not observable in the papermaking process.

Accordingly, an improved method is needed for producing pulp which is energy efficient and is able to produce MDF having improved water repellency properties.

SUMMARY OF THE INVENTION

Briefly, in one aspect, the present invention is a novel method for producing an MDF board from pulp from a fibrous lignocellulose material using a treatment or pretreatment step which exposes the material to oxalic acid or oxalic acid derivatives (particularly dialkyl ester derivatives, particularly in the vapor phase). The treated wood is then subjected to a sugar extraction wash and refined using any one of the several pulping methods to produce a final pulp product. Once this is done the pulp is used to make MDF boards having improved water repellency properties.

In one embodiment, the method includes heating the fibrous lignocellulose material (without reducing the material to a specific particle size) at a temperature of between about 90° C. and 170° C., more suitably between 130° C. and 140° C., in the presence of oxalic acid or oxalic acid derivatives (optionally in the vapor phase), prior to refining the material into a pulp. The dry weight amount of oxalic acid or oxalic acid derivative employed may be less than about 6%, or suitably less than about 5%, or more suitably between about 0.05% and 5%, or most suitably between about 1% and 3%, of the dry weight of the fibrous lignocellulose material. The treatment may be conducted at ambient pressures or higher, and for a period of time sufficient to allow the treated product to be later refined at reduced energy input levels as compared to untreated materials, typically less than about 4 hours.

Another aspect of the invention is a method of making medium density fiberboard having improved moisture tolerance comprising the steps or acts of providing a reduced material in water comprising one or more fibrous lignocelluloses having particle sizes in the range of 1-100 mm in length, treating the reduced material with a
compound having the formula

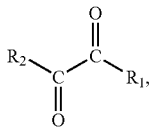

wherein $R_1$ and $R_2$ are independently a member selected from the group consisting of —OH, halide, substituted amine, unsubstituted amine, —$OR_3$, and

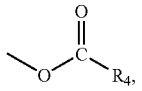

wherein $R_3$ and $R_4$ are independently a branched or unbranched, cyclic or linear, saturated or unsaturated, substituted or unsubstituted $C_{1-10}$ alkyl, at a temperature in the range of 90-170° C. generating a treated reduced material, extracting hemicellulose sugars from the treated reduced material before or after refining it to a pulp, adding a suitable resin to the fibrous pulp, and forming the fibrous pulp into medium density fiber board. In an alternative embodiment, the compound includes the proviso that at least one of $R_1$ and $R_2$ is other than —OH.

In an exemplary embodiment of the method, the reduced material is treated with less than 6 dry wt % of the compound.

In another exemplary embodiment of the method, the reduced material is treated with 0.05-5 dry wt % of the compound.

In another exemplary embodiment of the method, the reduced material is treated with 1-3 dry wt % of the compound.

In another exemplary embodiment of the method, $R_1$ and $R_2$ are —OH.

In another exemplary embodiment of the method, $R_1$ and $R_2$ are —$OR_3$, and $R_3$ is an ethyl.

In another exemplary embodiment of the method, $R_1$ and $R_2$ are —$OR_3$, and $R_3$ is a methyl.

In another exemplary embodiment of the method, the reduced material is treated at a pressure less than 90 psig.

In another exemplary embodiment of the method, the reduced material is treated for a duration less than 4 hours.

In another exemplary embodiment of the method, the reduced material is treated for a duration in the range of 5 min. to 2 hours.

In another exemplary embodiment of the method, the reduced material is treated at a temperature in the range of 130-140° C.

In another exemplary embodiment of the method, the suitable resin is a phenol-formaldehyde resin, and a wax is further added to the fibrous pulp.

In another exemplary embodiment of the method, the medium density fiber board comprises 93.5 wt % fiber, 6 wt % resin, and 0.5% wax.

In another exemplary embodiment of the method, the reduced material is provided by using a processing technique being mechanical pulping, thermo-mechanical pulping, or chemical treatment with mechanical pulping.

In another exemplary embodiment of the method, the method further includes the steps or acts of mechanically refining the treated reduced material one or more times to achieve a predetermined level of freeness of the treated reduced material, and, dewatering the refined and treated reduced material one or more times. The treated reduced material may be mechanically refined 2-6 times, whereby a freeness value of 100 ml CSF (Canadian Standard Freeness) is achieved.

In another exemplary embodiment of the method, the ratio of water:fibrous lignocellulose is in the range of 4:1 to 8:1.

In another exemplary embodiment of the method, the fibrous lignocellulose includes one or more hardwoods or softwoods, such as southern yellow pine, red pine, spruce, western hemlock, aspen, loblolly pine and recovered paper.

In another exemplary embodiment of the method, the particle size is in the range of 6-14 mm in length.

In another exemplary embodiment of the method, the reduced material is further treated with one or more suitable enzymes and/or acetic acid.

Another aspect of the invention is a medium density fiber board made by any one of the methods set forth herein.

Before the embodiments of the invention are explained in detail, it is to be understood that the invention is not limited in its application to the details of construction and the arrangements of the components set forth in the following description. The invention is capable of other embodiments and of being practiced or being carried out in various ways. Also, it is understood that the phraseology and terminology used herein are for the purpose of description and should not be regarded as limiting. The use of "including", "having" and "comprising" and variations thereof herein is meant to encompass the items listed thereafter and equivalents thereof as well as additional items and equivalents thereof.

It also is understood that any numerical value recited herein includes all values from the lower value to the upper value. For example, if a temperature range is stated as 100° C. to 170° C., it is intended that values such as 101° C. to 110° C., 102° C. to 105° C., etc., are expressly enumerated in this specification. These are only examples of what is specifically intended, and all possible combinations of numerical values between the lowest value and the highest value enumerated are to be considered to be expressly stated in this application.

Other objects, advantages and features of the present invention will become apparent from the following specification and claims.

DETAILED DESCRIPTION OF THE EXEMPLARY EMBODIMENTS

The present invention is a method for treating lignocellulosic materials so as to produce pulp which is used to make MDF boards. The present invention comprises a pretreatment step which exposes the material to oxalic acid or oxalic acid derivatives. In general, the step includes heat treating the fibrous lignocellulosic material (e.g., wood) in combination with oxalic acid or oxalic acid derivatives. The treated fibrous material is then refined using any one of several pulping methods to produce a pulp product. The treated material is subjected to a sugar extraction process before or after refining, and the released sugars may be recovered for other products.

The treatment method of the invention removes hemicellulose from both hardwoods and softwoods. Since the method releases hemicellulosic sugars it can be used in systems where hemicellulose is present and might be available for recovery and may or may not have to be removed to create another product from the material. Thus hardwood, softwood chips and bark could be used as well as pulp products and agricultural residues. The treatment of lignocellulosic materials by this process provides a hemicellulosic hydrolysate directly, but the saccharification of lignocellulose to sugars can further be enhanced by enzymes or further acid hydrolysis. The method also provides electrical energy savings in the production of pulp. The subsequent pulp is used to produce MDF boards having improved water repellency characteristics.

Fibrous lignocellulosic materials treated in accordance with the present invention are defined to generally include materials containing cellulose polymers, hemicellulose polymers and lignin. Such materials may include, for example, hardwoods (i.e., broad-leafed species) and softwoods (i.e., conifers). More specifically, these materials may include the Southern Yellow Pines, Spruces, Western Hemlock, Aspens, and other smaller diameter trees. The material may also originate from either round wood (e.g., whole trees), residue (e.g., wood scraps left behind from forest and sawmill operations), or recovered paper. Recovered paper may include both preconsumer recovered paper, such as trimmings and scraps from printing, carton manufacturing, or other converting processes which are reused to make pulp without reaching the final consumer, or post-consumer paper, such as corrugated boxes, newspapers, magazines, and office paper which has been recycled.

Oxalic acid derivative or derivatives (used interchangeably) as used herein is to be broadly construed. In the first instance alkyl and dialkyl mono and diesters of oxalic acid are intended. The alkyl moiety of the esters generally have from about 1 to about 10 carbon atoms, preferably about 1 to 6 and most preferably about 1 to 4 carbon atoms. The alkyl moiety may be substituted, unsubstituted, cyclic, linear, branched or unbranched but is predominantly hydrocarbon in character. Oxalic acid derivatives, in one embodiment could include carboxylic acid derivatives other than esters, e g., amides, acid halides, and anhydrides. Preferred oxalic acid derivative in the practice of this invention are the methyl and ethyl diesters of oxalic acid. Generally, the oxalic acid derivatives that can be used in the present invention, include oxalic acid derivatives for formula (I)

(I)

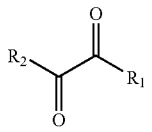

wherein $R_1$ and $R_2$ are independently hydroxyl, oxygen, a halide, a substituted or unsubstituted amine, $OR_3$ or a side chain of formula (II):

(II)

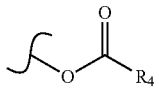

wherein $R_3$ and $R_4$ are independently a branched or unbranched, cyclic or linear, saturated or unsaturated, substituted or unsubstituted alkyl of from 1 to 10 carbon atoms; and wherein $R_1$ and $R_2$ cannot both be hydroxyl.

In general, prior to beginning the pretreatment process, the fibrous lignocellulose material is first reduced to a size appropriate for pulping. Methods of reducing fibrous lignocellulosic material to appropriate sizes for pulping are conventional in the art. Reducing the size of the fibrous lignocellulose material aids in having the material sufficiently treated with the oxalic acid or oxalic acid derivative. In one embodiment, the material to be treated is reduced to wood chips. Generally acceptable size for wood chips include chips in a size range of 1 mm to 100 mm in length. It is anticipated, however, that the present method may also be effective with materials not reduced to wood chips, such as those materials derived from recovered paper or wood residues or logs themselves. It is also anticipated that the present method may be effective in treating pulp itself.

The reduced fibrous lignocelluosic material is then treated with an amount of oxalic acid or an oxalic acid derivative. The level of oxalic acid or oxalic acid derivative used is empirically derived for the species of wood and the end use of the fiber. Higher concentrations may be used to recover hemicelluloses from wood chips destined for chemical pulps or total saccharification (enzymatic or second acid hydrolysis) than can be used for those to be used for mechanical and thermomechanical pulps. Generally, the amount of oxalic acid or oxalic acid derivative employed, as expressed in dry weight percentage, may be less than about 6%, or suitably less than about 5%, or more suitably between about 0.05% and 5%, or even more suitably between about 1% and 3%, of the dry weight of the fibrous lignocellulosic material.

In one embodiment, the method comprises adding oxalic acid, dimethyloxalate or diethyloxalate oxalic acid esters in the presence of heated wood chips, pulp or any lignocellulosic source that has some water of hydration. Suitably the wood chips are first heated in a digester, using direct atmospheric steam injection to exclude air from the digester and bring the chips up to a temperature required for reaction. The digester is then suitably brought up to around 30 psig steam pressure (although 0 to 90 psig steam can be used) by a combination of steam injection and jacket pressure. This is continued until a stable temperature and pressure are obtained. The temperature used is generally greater than 100° C., typically between 130° C. and 140° C. No upper limit has been established and temperatures of 170° C. have been used to extract sugars.

Oxalic acid or oxalic acid derivatives of low volatility are suitably applied by impregnating the steamed wood chips with a liquid solution. Volatile oxalic acid derivatives such as dimethyloxalate or diethyloxalate may alternatively be applied by injecting into the digester by gas pressure, suitably using carbon dioxide or nitrogen. Generally, the pressure of the reaction increases slightly due to the vaporization of the chemical and diminishes within 2-3 minutes. The diethyloxalate or dimethyloxalate oxalic acid esters rapidly vaporize allowing for the delivery of the chemical into wood chips. The vaporized chemical contacts water present within the wood chips and at least one ester hydrolyzes to liberate acid which acidifies the water. Since the water is kept to a minimum the acid concentration is high and proportional to the amount of chemical injected. The elevated temperature and localized acidity combine to hydrolyze the hemicellulosic sugars present in the wood chips. Other reactions such as esterification and transesterification are also possible during this incubation. The delivery of the reactants via the vapor phase provides a high concentration of acid at the water surface layer in the chips.

The oxalate ester will generate a vapor concentration of the chemical that is dependant on the volume of the vessel and amount of chemical used. Increasing the concentration of the oxalate ester in the vessel will increase the amount of carbohydrate liberated from a given weight of wood chips. A threshold value of oxalate ester has been observed, under a set time and temperature, in pine and spruce where the increase in sugars liberated decreases relative to the increase of oxalate ester used. This threshold value has not been observed for liberation of hemicellulosic sugars from aspen and maple. In one embodiment, a range of 0 to 100 ml of oxalic acid or diethyl oxalate has been used for the treatment of aspen, oak, maple, southern yellow pine, red pine and spruce in a reactor with a total volume of 21.4 liters. In this embodiment, increasing the wood chips (from 1.25 kg to 2.5 kg oven dry basis) increased the amount of hemicellulosic sugars liberated from the wood chips.

Suitably, the treated wood chips are maintained at a steady temperature for a time period of between 5 minutes and 2 hours. Maintaining the wood chips in the digester for a more extended time will release more hemicellulosic sugars. Increasing the temperature of reaction or chemical loading will also release more hemicellulosic sugars. A temperature systematically increasing and/or decreasing in time may also be employed.

Conventional hot water extraction may be used for hemicellulosic sugar extraction. Suitably, the wood chips may be heated to 170° C. for 30 minutes with hot water at a water to wood ratio of 4:1. The water may be collected for extractives including the sugars, etc. for fermentation or other uses.

The extracted, washed wood chips are then ready for pulping. Many pulping methods are suitable for the present invention including mechanical and chemical pulping methods. Mechanical pulping methods include mechanical pulping, thermo-mechanical pulping (TMP), chemical treatment with thermo-mechanical pulping (CTMP), and chemi-mechanical pulping (CMP). Chemical pulping methods include chemical pulping, sulfate (kraft) and sulfite processes. Suitably, the wood chips are used for thermomechanical pulp generation. Thermomechanical pulp generation with treated chips have been shown to provide energy savings from 25 to 50%.

In one embodiment, when the treated wood chips are subjected to mechanical pulping, dilution water is added to the treated material and the material is run through a mechanical refiner in a number of sequential passes. The number of passes of the treated material/pulp mixture will depend upon the freeness desired for the particular MDF to be made. The treated material/pulp mixture is repeatedly fed through refiners until the desired level of freeness is achieved. The pulp may also be dewatered as necessary between passes. Loblolly pine, treated using the procedures described above, requires between about 2 to 6 repeated passes to obtain a 100 ml CSF value in a single rotating 300 mm diameter disk atmospheric refiner.

The overall energy efficiency of the process can be compared with that of a standard process by pulping untreated material in the same apparatus while at the same time monitoring the energy consumption of the refining mill. Generally speaking the treated material requires significantly less energy input through the refiner to achieve the same level of freeness in the resulting pulps.

The pulps made through this procedure may then be made into MDF boards using standard techniques.

The present invention is further explained by the following examples which should not be construed by way of limiting the scope of the present invention.

EXAMPLES

Example 1

Properties of MDF made from wood pretreated with OA and DEO. Red pine logs were obtained from SENA. Logs were debarked and chipped at FPL to a nominal size of 6-14 mm Chips were placed in barrels and frozen to prevent the growth of contaminating microorganisms. Their moisture content was 42%.

Processing of control chips. Untreated (control) red pine wood chips were placed in a large rotating digester and steam was introduced to displace air and bring the chips to temperature (135-140° C.). External temperature measurement was used as well as an internal probe as a secondary source of temperature measurement. The chips were cooked for 30 minutes at 135° C. Following the cook, the wood chips were subjected to a sugar extraction procedure consisting of atmospheric hot water washing (~240 liters, a water to wood ratio of 8:1) at a temperature of 80° C. for 30 minutes to collect the extractives including the sugars, etc. for fermentation. The wood chips were then collected and stored at 4° C. until TMP processing for MDF fiber.

Processing of Hot Water Chips. Untreated (control) red pine wood chips were placed in a large rotating digester along with water (at a water to wood ratio of 4:1). The temperature was raised to 170° C. and then held at that temperature for 15 minutes. External temperature measurement was used to monitor the temperature. Following the cook, the wood chips were subjected to a sugar extraction procedure consisting of atmospheric hot water washing (increasing the water volume to 240 liters, in a final water to wood ratio of 8:1) at a temperature of 80° C. for 30 minutes to collect the extractives including the sugars, etc. for fermentation. The wood chips were then collected and stored at 4° C. until TMP processing for MDF fiber.

Processing of oxalic acid (OA) treated chips. Oxalic acid dihydrate from Sigma-Aldrich was used in a quantity of 35 grams into 7500 ml. water at (0.33% wt. solution of oxalic acid) per 2.5-kilograms oven dried wood chips. Red pine wood chips were placed in a large rotating digester and steam introduced to displace air and bring the chips to temperature (100° C.). The steam was stopped and a vacuum drawn on the digester and the oxalic acid solution was admitted and allowed to impregnate the chips. The excess solution was drained and the temperature brought to 135° C. When at temperature the chips were cooked for 10 minutes. Following the cook, the wood chips were subjected to a sugar extraction procedure consisting of atmospheric hot water washing (~240 liters, a water to wood ratio of 8:1) at a temperature of 80° C. for 30 minutes to collect the extractives including the sugars, etc. for fermentation. The wood chips were then collected and stored at 4° C. until TMP processing for MDF fiber.

Processing of diethyloxalate (DEO) treated chips. Diethyloxalate from Sigma Aldrich was used in a quantity of 20-ml. per 1-kilogram oven dried wood chips. Red pine wood chips were placed in a large rotating digester and steam introduced to displace air and bring the chips to temperature (140° C.). When at temperature the DEO was introduced by an injector pipe attached to the top of the digester and forced into the digester using carbon dioxide or nitrogen gas pressure. External temperature measurement and an internal temperature measurement probe were used. Chips were cooked for 30 minutes at 140° C. Following the cook, the wood chips were subjected to a sugar extraction procedure consisting of atmospheric hot water washing (~240 liters, a water to wood ratio of 8:1) at a temperature of 80° C. for 30 minutes to collect the extractives including the sugars, etc. for fermentation. The wood chips were then collected and stored at 4° C. until TMP processing for MDF fiber.

TMP Production. The cooked wood chips prepared as indicated above were fiberized in a Laboratory Pressurized Refiner (TMP). The TMP is a 12-inch single disc pressurized mechanical Sprout-Bauer, model# 12-1CP. Energy consumption was measured using an Ohio Semitronic Model WH 30-11195 Integrating Wattmeter attached to the power supply side of the 44.8 kW electric motor. The feed rate through the refiner was 1 kg/min. Energy was reported in W·h/kg. The refiner plate gap settings were approximately 0.005 inch.

MDF production. The fiberized wood as made into 19 mm thick panels, made at 5% moisture content using a commercial phenol-formaldehyde resin. After preparation the boards were cut and physical properties of the boards determined using the standard testing techniques found in the (ASTM D 1037-78, 2005) American Society for Testing and Materials. 2005. Annual book of ASTM Standards. Vol. 04.10 Wood. ASTM International, West Conshohocken, Pa., which is incorporated by reference here in its entirety. The study shows that hemicellulosic sugars can be removed and recovered prior to MDF production and the MDF has enhanced properties compared to the control. The results for the study are shown in Table 1.

TABLE 1

| Wood treatment | Water soak (24 hour) Swell (%) | Water soak (24 hour) Absorption (%) | Carbohydrate released, % of wood chip |
|---|---|---|---|
| Control | 9.1 | 30.6 | 1.1 |
| Oxalic acid | 4.0 | 16.0 | 4.4 |
| DEO | 3.8 | 13.5 | 5.3 |
| Hot water | 12.0 | 93.9 | 7.6 |

Table 1 Red pine medium density fiberboard tests and extent of carbohydrate removal. MDF properties from boards containing 93.5% fiber, 6% resin and 0.5% wax.

It was not evident that the samples would have increased water repellency as a result of the OA and DEO pretreatments and subsequent extraction,. The normal extraction procedures that are done with hot water have not been shown to have this benefit to the MDF production.

Example 2

Materials and Methods. Wood chips. Red pine logs were obtained from SENA. Logs were debarked and chipped at FPL to a nominal size of 6-14 mm. Chips were placed in barrels and frozen to prevent the growth of contaminating microorganisms. Moisture content was 42%. After the experimental cooking procedures, the wood chips were collected and stored at 4° C. until TMP processing for MDF fiber.

Experimental cooks. Control red pine wood chips were subjected to time and temperature and extraction protocols, but without chemical cook (positive control). Following the cook, the wood chips were subjected to the extraction procedure consisting of atmospheric hot water washing (~240 liters) to collect the extractives including the sugars, etc. for fermentation.

Oxalic acid dihydrate obtained from Sigma-Aldrich was used in a quantity of 35 grams into 7500 ml. water at 70° C. (0.33% solution of oxalic acid) per 2.5-kilograms oven dried wood chips. A rotating digester was used to cook the wood chips to the desired temperature and time. External temperature measurement and an internal temperature measurement probe were used. The chips were cooked for 10 minutes at 135° C. Following the cook, the wood chips were subjected to the extraction procedure consisting of atmospheric hot water washing (~240 liters) to collect the extractives including the sugars, etc. for fermentation.

Diethyloxalate (DEO) obtained from Sigma Aldrich was used in a quantity of 20-ml. per 1-kilogram oven dried wood chips. A rotating digester was used to cook the wood chips to the desired temperature and time. External temperature measurement and an internal temperature measurement probe were used. Chips were cooked for 30 minutes at 135° C. Following the cook, the wood chips were subjected to the extraction procedure consisting of atmospheric hot water washing (~240 liters) to collect the extractives including the sugars, etc. for fermentation.

Pine wood chips were subjected to hot water extraction. The wood chips were heated to 170° C. for 30 minutes with hot water, where the water to wood ratio was 4:1. Following the cook, the water was collected for extractives including the sugars, etc. for fermentation.

Fiber production for the TMP process. Cooked wood chips were fiberized in a Laboratory Pressurized Refiner (TMP). The TMP was a 12-inch single disc pressurized mechanical Sprout-Bauer, Model# 12-1CP. Energy consumption was measured using an Ohio Semitronic Model WH 30-11195 integrating a Wattmeter attached to the power supply side of the 44.8 kW electric motor. Feed rate through the refiner was 1 kg/min Energy is reported in W·h/kg. Refiner plate gap settings were approximately 0.005 inch.

MDF production. 19 mm thick panels were made at 5% moisture content using a commercial phenol-formaldehyde resin. After preparation, the boards were cut and physical properties of the boards determined using the standard testing techniques found in ASTM D 1037-78, 2005. American Society for Testing and Materials (2005), Annual book of ASTM Standards, Vol. 04.10, Wood, ASTM International, West Conshohocken, Pa.

Results. After OA and DEO pretreatments, hemicellulosic sugars can be removed and recovered prior to MDF production and the MDF has enhanced properties compared to both the raw control and the hot water control.

TABLE 2

Red pine medium density fiberboard tests and extent of carbohydrate removal.

| Wood treatment | Bending MOR ($N/mm^2$) | Bending MOE ($N/mm^2$) | Internal bond ($N/mm^2$) | Water soak (24 hour) Swell (%) | Water soak (24 hour) Absorption (%) | Carbohydrate released % Wood chip |
|---|---|---|---|---|---|---|
| Control | 16.8 | 1824.9 | 0.179 | 9.1 | 30.6 | 1.1 |
| Oxalic acid | 14.3 | 1457.3 | 0.241 | 4.0 | 16.0 | 4.4 |
| DEO | 14.3 | 1498.5 | 0.193 | 3.8 | 13.5 | 5.3 |
| Hot water | 16.2 | 1598.6 | 0.172 | 12.0 | 93.9 | 7.6 |

Note:
MDF properties from boards containing 93.5% fiber, 6% resin and 0.5% wax.

Unexpected superior results. It was not evident that the samples would have increased water repellency as a result of the OA and DEO pretreatments and subsequent sugar extractions. The normal extraction procedures that are done with hot water have not been shown to have this benefit to the MDF production. We were surprised to see this result.

Example 3

Pilot scale data were generated at the Andritz Research and Development Laboratory in Springfield, Ohio. The Andritz facility is known to provide refining results similar to industrial scale such that data obtained can be used for scaled up with confidence. The procedures used to process both the red pine and the spruce wood used in the refining tests at Andritz were the same procedures as described above for materials and methods.

TABLE 3

Pilot-scale refining results from Andritz on spruce.

| Wood treatment | Bending MOR ($N/mm^2$) | Bending MOE ($N/mm^2$) | Internal bond ($N/mm^2$) | Water soak (24 hour) Swell (%) | Water soak (24 hour) Absorption (%) | Carbohydrate released % Wood chip |
|---|---|---|---|---|---|---|
| Spruce Control | 13.5 | 1558 | 0.18 | 31.2 | 110.0 | 1.2 |
| Spruce Oxalic Acid | 14.8 | 1951 | 0.41 | 14.8 | 66.6 | 3.5 |
| Spruce DEO | 19.3 | 1951 | 0.44 | 10.0 | 32.1 | 4.0 |

Note:

MDF properties from boards containing 93.5% fiber, 6% resin and 0.5% wax. Carbohydrate is the total identified carbohydrate (mannose + xylose + arabinose + glucose + galactose, in decreasing order) released as a percentage of the weight of the wood chips.

TABLE 4

Pilot-scale refining results from Andritz on red pine.

| Wood treatment | Bending MOR ($N/mm^2$) | Bending MOE ($N/mm^2$) | Internal bond ($N/mm^2$) | Water soak (24 hour) Swell (%) | Water soak (24 hour) Absorption (%) | Carbohydrate released % Wood chip |
|---|---|---|---|---|---|---|
| Red Pine Control | 19.3 | 2124 | 0.31 | 19.6 | 72.6 | 1.0 |
| Red Pine Oxalic Acid | 15.4 | 1579 | 0.32 | 15.2 | 39.2 | 5.5 |

Note:

MDF properties from boards containing 93.5% fiber, 6% resin and 0.5% wax. Carbohydrate is the total identified carbohydrate (mannose + xylose + arabinose + glucose + galactose, in decreasing order) released as a percentage of the weight of the wood chips.

For the treated red pine wood chips, the resulting MDF strength was slightly lower than the control. However, the unexpected water repellency was evident. For the treated spruce wood chips, the water repellency was again unexpectedly increased over the control, and the strength of the resulting MDF was also surprisingly enhanced. The red pine species in Table 4 was very similar to that shown in Table 2.

UTILITY OF THE DESCRIBED EMBODIMENTS

MDF is widely used as a structural material in objects such as buildings and furniture. In many of these uses the MDF may become exposed to water. It is well known that exposure to water causes deterioration of conventionally-produced MDF, resulting in losses of mechanical integrity, dimensional stability, and asthetic appearance. Because of this it is common to restrict the use of MDF to applications free from moisture exposure, and/or to apply protective paints, varnishes, or other coatings in an attempt to ameliorate the negative effects of moisture on the material. These applied coatings represent an additional cost and may not be fully satisfactory for various uses.

Methods currently in use to improve the water repellency of MDF involve the addition of water-repellent materials to the MDF. Additional binding resin and/or specific water repellency materials can be added to the MDF. A useful and distinguishing feature of applicants' invention is that additional water repellent materials need not be added to the MDF. This is because the improved water repellency is achieved through an initial chemically-induced modification to the lignocellulosic material itself before the MDF is formed. The modified lignocellulosic fibers remain compatible with the binding resin used to form the board.

While the present invention has now been described and exemplified with some specificity, those skilled in the art will appreciate the various modifications, including variations, additions, and omissions that may be made in what has been described. Accordingly, it is intended that these modifications also be encompassed by the present invention and that the scope of the present invention be limited solely by the broadest interpretation that lawfully can be accorded the appended claims.

We claim:

1. A method of making Medium Density Fiberboard (MDF) having improved moisture tolerance comprising:

providing a fibrous lignocellulose material;

treating the material with a compound having the formula

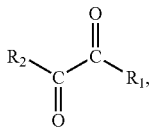

wherein $R_1$ and $R_2$ are independently a member selected from the group consisting of —OH, halide, substituted amine, unsubstituted amine, —$OR_3$, and

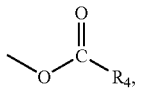

wherein $R_3$ and $R_4$ are independently a branched or unbranched, cyclic or linear, saturated or unsaturated, substituted or unsubstituted $C_{1-10}$ alkyl, at a temperature in the range of 90-170° C. generating a treated material;

extracting hemicellulose sugars from the treated material;

refining the treated material to generate a fibrous pulp, wherein the refining step can be performed either before or after the extraction step;

adding a suitable resin to the fibrous pulp; and forming the fibrous pulp into medium density fiber-board, wherein $R_1$ and $R_2$ cannot both be —OH.

2. The method of claim 1, wherein the fibrous lignocellulose includes one or more members selected from the group consisting of southern yellow pine, red pine, spruce, western hemlock, aspen, loblolly pine and recovered paper.

3. The method of claim 1, wherein the fibrous lignocellulose material is reduced to a particle size in the range of 1-100 mm in length.

4. The method of claim 3, wherein the reduced material is treated with less than 6 dry wt % of the compound.

5. The method of claim 3, wherein the reduced material is treated with 0.05-5 dry wt % of the compound.

6. The method of claim 3, wherein the reduced material is treated with 1-3 dry wt % of the compound.

7. The method of any one of claims 3-6, wherein $R_1$ and $R_2$ are —$OR_3$, and wherein $R_3$ is an ethyl.

8. The method of any one of claims 3-6, wherein $R_1$ and $R_2$ are —$OR_3$, and wherein $R_3$ is a methyl.

9. The method of claim 3, wherein the reduced material is treated at a pressure less than 90 psig.

10. The method of claim 3, wherein the reduced material is treated for a duration less than 4 hours.

11. The method of claim 3, wherein the reduced material is treated for a duration in the range of 5 min. to 2 hours.

12. The method of claim 3, wherein the reduced material is treated at a temperature in the range of 130-140° C.

13. The method of claim 3, wherein the suitable resin is a phenol-formaldehyde resin, and wherein a wax is further added to the fibrous pulp.

14. The method of claim 13, wherein the medium density fiber board comprises 93.5 wt % fiber, 6 wt % resin, and 0.5% wax.

15. The method of claim 3, wherein the reduced material is refined by using a processing technique selected from the group consisting of mechanical pulping, thermo-mechanical pulping, and chemical treatment with mechanical pulping.

16. The method of claim 3, further comprising:

mechanically refining the treated reduced material one or more times to achieve a predetermined level of freeness of the treated reduced material; and dewatering the refined and treated reduced material one or more times.

17. The method of claim 16, wherein the treated reduced material is mechanically refined 2-6 times, and wherein a freeness value of 100 ml CSF is achieved.

18. The method of claim 1, wherein the ratio of water: fibrous lignocellulose is in the range of 4:1 to 8:1.

19. The method of claim 2, wherein the particle size is in the range of 6-14 mm in length.

20. The method of claim 3, wherein the step of treating the reduced material includes cooking the material at a temperature in the range of 90-170° C.

21. The method of claim 3, wherein the reduced material is further treated with one or more suitable enzymes and/or acetic acid.

* * * * *

UNITED STATES PATENT AND TRADEMARK OFFICE

CERTIFICATE OF CORRECTION

PATENT NO. : 8,123,904 B2
APPLICATION NO. : 12/854574
DATED : February 28, 2012
INVENTOR(S) : Masood Akhtar et al.

It is certified that error appears in the above-identified patent and that said Letters Patent is hereby corrected as shown below:

Column 14, line 36, Claim 13, "The method of claim 3" should read --The method of claim 1--.

Column 14, line 39, Claim 14, "The method of claim 13" should read --The method of claim 1--.

Column 14, line 46, Claim 16, "The method of claim 3" should read --The method of claim 1--.

Signed and Sealed this
Twenty-fourth Day of April, 2012

David J. Kappos

David J. Kappos
*Director of the United States Patent and Trademark Office*

UNITED STATES PATENT AND TRADEMARK OFFICE

CERTIFICATE OF CORRECTION

PATENT NO. : 8,123,904 B2
APPLICATION NO. : 12/854574
DATED : February 28, 2012
INVENTOR(S) : Masood Akhtar et al.

It is certified that error appears in the above-identified patent and that said Letters Patent is hereby corrected as shown below:

Column 14, line 57, Claim 19, "The method of claim 2" should read --The method of claim 18--.

Signed and Sealed this
First Day of May, 2012

David J. Kappos

David J. Kappos
*Director of the United States Patent and Trademark Office*